US008573650B2

(12) United States Patent
Gregarek et al.

(10) Patent No.: US 8,573,650 B2
(45) Date of Patent: Nov. 5, 2013

(54) SECURITY FEATURE AND METHOD FOR MANUFACTURING THE SAME

(75) Inventors: André Gregarek, München (DE); Manfred Heim, Bad Tölz (DE); Bernhard Wiedner, Miesbach (DE)

(73) Assignee: Giesecke & Devrient GmbH (DE)

( * ) Notice: Subject to any disclaimer, the term of this patent is extended or adjusted under 35 U.S.C. 154(b) by 519 days.

(21) Appl. No.: 12/665,214

(22) PCT Filed: Jun. 19, 2008

(86) PCT No.: PCT/EP2008/004923
§ 371 (c)(1),
(2), (4) Date: Dec. 17, 2009

(87) PCT Pub. No.: WO2009/003588
PCT Pub. Date: Jan. 8, 2009

(65) Prior Publication Data

US 2010/0164217 A1 Jul. 1, 2010

(30) Foreign Application Priority Data

Jul. 3, 2007 (DE) ..... 10 2007 030 946
Aug. 2, 2007 (DE) ..... 10 2007 036 623

(51) Int. Cl.
*B42D 15/00* (2006.01)
*B42D 15/10* (2006.01)

(52) U.S. Cl.
USPC ..... 283/72; 283/85; 283/86; 283/91; 283/114

(58) Field of Classification Search
USPC ..... 283/72, 74, 85, 86, 91, 114
See application file for complete search history.

(56) References Cited

U.S. PATENT DOCUMENTS

| | | | | |
|---|---|---|---|---|
| 4,343,885 | A | 8/1982 | Reardon, Jr. | |
| 4,732,410 | A * | 3/1988 | Holbein et al. | 283/114 |
| 5,261,954 | A * | 11/1993 | Collings | 283/114 |
| 5,298,922 | A * | 3/1994 | Merkle et al. | 283/85 |
| 6,082,778 | A * | 7/2000 | Solmsdorf | 283/85 |
| 6,428,051 | B1 | 8/2002 | Herrmann et al. | |
| 2002/0030360 | A1 * | 3/2002 | Herrmann et al. | 283/72 |
| 2003/0161017 | A1 * | 8/2003 | Hudson et al. | 283/85 |
| 2004/0232691 | A1 * | 11/2004 | Lazzerini | 283/67 |
| 2006/0141391 | A1 | 6/2006 | Klein et al. | |
| 2008/0191462 | A1 * | 8/2008 | Depta et al. | 283/114 |
| 2008/0250954 | A1 * | 10/2008 | Depta et al. | 283/72 |

FOREIGN PATENT DOCUMENTS

| | | |
|---|---|---|
| DE | 4334848 C1 | 1/1995 |
| DE | 4334847 A1 | 4/1995 |

(Continued)

*Primary Examiner* — Kyle Grabowski
(74) *Attorney, Agent, or Firm* — The Webb Law Firm

(57) ABSTRACT

A method for manufacturing a security feature for a security element, a security paper or a data carrier that exhibits a substrate into which at least one through opening and at least one marking in registration with the through opening are to be introduced. The method includes the steps of providing a substrate with a laser-modifiable marking substance at least in the region of the marking to be produced and, in the same operation, introducing at least one through opening into the substrate by the action of laser radiation at higher laser power and modifying the laser-modifiable marking substance in the marking region by the action of laser radiation at a lower laser power to produce at least one marking in registration with the through opening.

21 Claims, 3 Drawing Sheets

(56) References Cited

FOREIGN PATENT DOCUMENTS

| | | | | |
|---|---|---|---|---|
| EP | 0290750 | B1 | | 1/1994 |
| EP | 0956975 | A2 | | 11/1999 |
| EP | 1661729 | A2 | | 5/2006 |
| EP | 1260381 | B1 | | 4/2007 |
| WO | 0203104 | A2 | | 1/2002 |
| WO | 02101462 | A1 | | 12/2002 |
| WO | 2005108109 | A1 | | 11/2005 |
| WO | WO2005108109 | | * | 11/2005 |
| WO | WO2006128607 | | * | 12/2006 |

* cited by examiner

SECURITY FEATURE AND METHOD FOR MANUFACTURING THE SAME

BACKGROUND OF THE INVENTION

1. Field of the Invention

The present invention relates to a security feature for a security element, a security paper or a data carrier that exhibits a substrate into which at least one through opening and at least one marking in registration with the through opening are to be introduced. The present invention especially relates to a method for manufacturing such a security feature, as well as a security element, a security paper and a data carrier having such a security feature.

2. Description of Related Art

Identification cards, such as credit cards or identity cards, are often provided with an individual identifier by means of laser engraving. Also the production of through openings in value documents by laser cutting has long been known. For example, in publication DE 43 34 848 C1 is described a security paper having, sealed by a transparent cover foil, a window-like through hole that can be produced by a laser-cutting process.

SUMMARY OF THE INVENTION

Based on that, it is the object of the present invention to further improve security elements, security papers and data carriers of the kind cited above with a view to their security against reproduction.

This object is solved by the method having the features of the main claim. A corresponding security element, a security paper and a data carrier having such a security feature are specified in the coordinated claims. Developments of the present invention are the subject of the dependent claims.

According to the present invention, in a generic method, it is provided that a) the substrate is provided with a laser-modifiable marking substance at least in the region of the marking to be produced, and b) in the same operation b1) at least one through opening is introduced into the substrate by the action of laser radiation at higher laser power, and b2) the laser-modifiable marking substance is modified in the marking region by the action of laser radiation at lower laser power and, in this way, at least one marking in registration with the through opening is produced.

The sequence of steps b1) and b2 is arbitrary. Step b1) can be carried out first and only then step b2), or also step b2) first and thereafter step b1).

The method according to the present invention relates to the manufacture of a security feature that can be present in a separate security element for application to or introduction into a data carrier, or in a security paper or a security foil for manufacturing value documents or the like, or in a data carrier, such as a banknote, identification card or the like. What is essential here is merely that the security element, security paper or data carrier provides for the security feature a substrate into which the through openings and the markings in registration therewith are introduced. Even if, for the sake of simplicity, openings and markings are usually referred to in the following in the plural, it is always understood that, according to the present invention, also only a single opening and a single marking can be provided in the substrate.

In an advantageous variant of the present invention, at least one through opening and at least one registered marking are produced to transition into one another without spacing. This can be achieved, for example, in that the laser beam is guided continuously along the opening to be cut and the marking to be introduced and, in the process, the laser energy is reduced at the transition of the opening to be cut and the marking to be introduced, from a high laser energy that exceeds the energy needed to cut the substrate, to a lower energy value that no longer suffices to cut the substrate but still lies above the reaction energy of the marking substance. Through this measure, the opening and the marking are produced in the same operation with the same laser beam and are thus highly precisely registered with each other.

According to a further advantageous variant of the present invention, at least one through opening and at least one registered marking can be produced spaced apart from each other. For this, with continuous guidance of the laser beam, the laser energy can, in the gap between the opening to be cut and the marking to be introduced, be lowered to zero or at least to a value below the reaction energy of the marking substance. In this way, the opening, gap and marking are produced in the same operation with the same laser beam and are thus highly precisely registered with each other.

The substrate can advantageously be kept free from laser-modifiable marking substance in the region of the through openings such that it is precluded that the edge region of the openings is modified by the laser beam.

Alternatively, the substrate can also be provided with laser-modifiable marking substance in the region of the through openings such that, upon introducing the through openings, the laser-modifiable marking substance in the vicinity of the openings is modified by the cutting laser beam. Here, the phrase "vicinity of the openings" also encompasses, in addition to the edge region immediately adjoining the opening, a region that lies near the opening at a certain small distance. Depending on the application, the small distance can be a few tenths of a millimeter or also a few millimeters.

To provide the substrate with the marking substance, in an advantageous variant of the present invention, it is coated on its surface with the marking substance, for example through a printing process. According to another, likewise advantageous, variant of the present invention, the marking substance is introduced into the volume of the substrate. Different methods are available for this depending on the substrate material.

If the substrate is formed from paper, the marking substance can advantageously be added to the paper pulp already at sheet formation. A further advantageous possibility consists in introducing the marking substance into the volume of the paper substrate in an immersion bath or impregnating the paper substrate with the marking substance in a size press. If the substrate is formed from a plastic foil, the marking substance can likewise be introduced into the volume of the foil already at the manufacture of the foil or subsequently through an impregnation step.

Advantageously, substances whose visible color is changed by the action of the laser radiation may be used as the marking substance. For this, for example, thermoreactive color pigments can be used, such as ultramarine blue. Advantageously, also marking substances can be used whose infrared-absorbing, magnetic, electrical or luminescent properties are changed by the action of the laser radiation. Security features having openings having such a laser-modified marking substance region can especially be used for mechanical authenticity testing. Also the use of a combination of different marking substances may be considered, for example to facilitate both a visual and a machine authenticity check of the security feature.

The through openings can especially be produced in the form of perforations, cuts or expansive window regions.

In the variants of the present invention in which the substrate is provided with a laser-modifiable marking substance also in the region of the openings, it can especially be modified in an edge region immediately adjoining the openings to be produced by the action of laser radiation.

According to an advantageous variant of the present invention, laser-modifiable effect pigments are used as the laser-modifiable marking substance. Such effect pigments are available to the person of skill in the art with different properties, especially with respect to their surface color, the color change under laser action, the threshold energy and the required laser wavelength. Also effect pigments that, upon laser irradiation, don't change (only) their visible color, but rather their infrared-absorbing, magnetic, electrical or luminescent properties, are known to the person of skill in the art. The modification of the effect pigments can be done with laser radiation in the ultraviolet, visible or infrared spectral range, for example with a $CO_2$ laser of a wavelength of 10.6 μm.

In a further, likewise advantageous, variant of the present invention, a pigment-free laser-modifiable marking substance is used. Also pigment-free marking substances can be applied to the substrate or introduced into the substrate volume, for example as intaglio or printing ink. With pigment-free marking substances, a high-transparency coating can be produced into which a permanent and high-contrast marking can be introduced by laser action at high speed. Pigment-free marking substances can be modified by laser radiation in the ultraviolet, visible or infrared spectral range, for example with the 10.6 μm radiation of a $CO_2$ laser. Concrete, non-limiting examples of pigment-free, laser-modifiable marking substances are specified in publications WO 02/101462 A1, U.S. Pat. No. 4,343,885 and EP 0290 750 B1, the disclosure of which is incorporated herein by reference.

The present invention also comprises a security element for security papers, value documents and the like having a security feature manufactured according to the described method, the security element exhibiting a substrate into which are introduced, by the action of laser radiation, at least one through opening and at least one marking in registration with the through opening, and that includes a laser-modified marking substance in the region of the marking. Such a security element can be developed, for example, in the form of a security thread, a label, a transfer element or a cover foil for a window region or a hole in a value document, such as a banknote.

In addition, the present invention also comprises a security paper for manufacturing value documents or the like, having a security feature manufactured according to the described method, the security paper exhibiting a substrate into which are introduced, by the action of laser radiation, at least one through opening and at least one marking in registration with the through opening, and that includes a laser-modified marking substance in the region of the marking. Instead of introducing the openings directly into the security paper, this security paper can also be provided with a security element of the kind described above.

The present invention further includes a data carrier having a security feature manufactured according to the described method, especially a value document, such as a banknote, identification card or the like, the data carrier exhibiting a substrate into which are introduced, by the action of laser radiation, at least one through opening and at least one marking in registration with the through opening, and that includes a laser-modified marking substance in the region of the marking. Instead of introducing the openings directly into the data carrier, this data carrier can also be provided with a security element according to the present invention or be manufactured from a security paper according to the present invention.

Further exemplary embodiments and advantages of the present invention are explained below by reference to the drawings, in which a depiction to scale and proportion was omitted in order to improve their clarity.

DETAILED DESCRIPTION OF THE PREFERRED EMBODIMENTS

Figure 1:
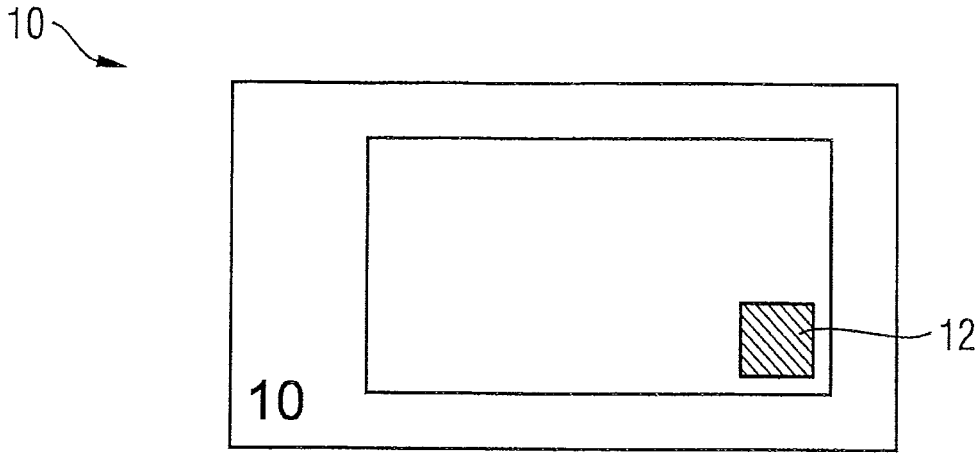
FIG. 1 is a schematic diagram of a banknote having a feature region according to the present invention.

The invention will now be explained using a banknote as an example. For this, FIGS. 1 and 2 show a schematic diagram of a banknote 10 that is provided, in an inventive feature region 12 depicted in greater detail in FIG. 2, with a laser hole and an associated, highly precisely registered marking.

Figure 2:
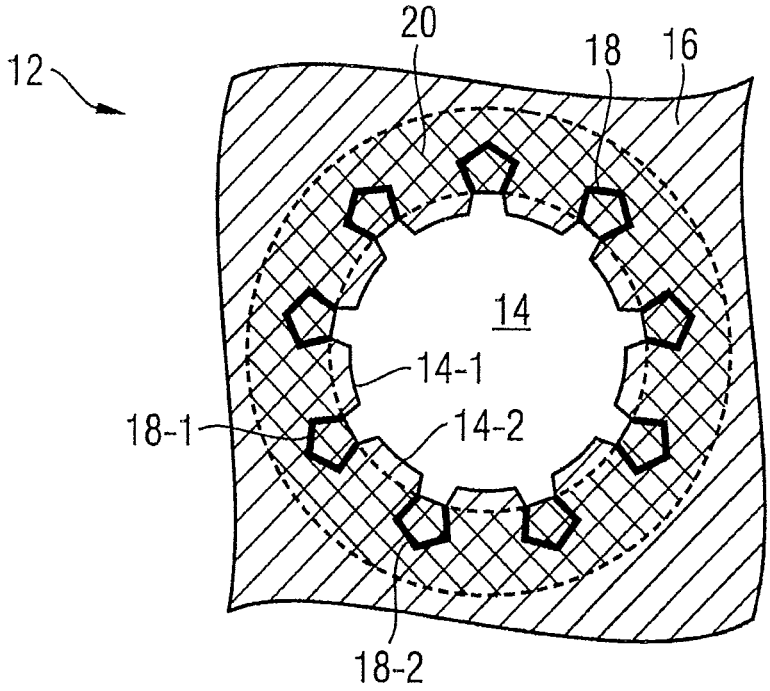
FIG. 2 is a detailed top view of the feature region in FIG. 1.

With reference to the top view in FIG. 2, in the feature region 12, a through opening 14 was cut in the paper substrate 16 of the banknote 10 by the action of laser radiation. The opening 14 transitions at multiple locations directly into a colored, for example red, marking 18 that is formed in the exemplary embodiment by a series of applied pentagons and that is highly precisely registered with the opening 14.

To produce the opening 14 and the marking 18 in registration, in the region 20 of the marking to be produced, the paper substrate 16 was provided, before the laser cutting, with a laser-modifiable marking substance that displays the desired color change upon the action of laser radiation.

Figure 3:
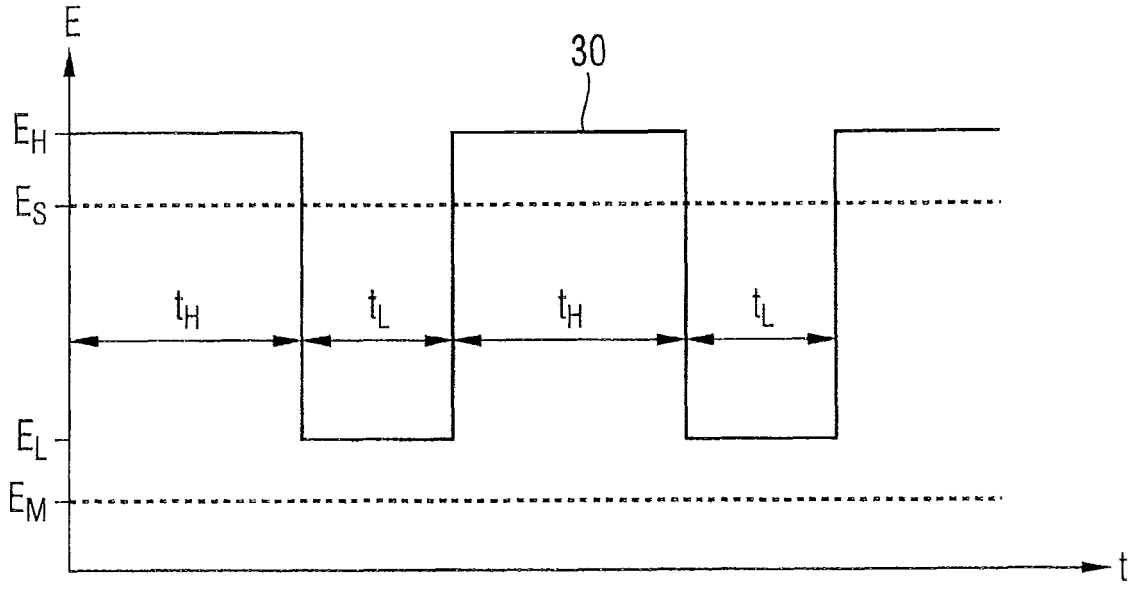
FIG. 3 is a schematic view of the progression of the laser energy over time upon producing a through opening and a registered marking in a method according to the present invention.

During the laser cutting, the laser power is specifically varied to be able to alternate between the cutting of the paper and the modification of the marking substance. For this, FIG. 3 shows schematically the progression 30 of the laser energy over time when laser cutting. $E_S$ designates the threshold energy needed to cut the paper substrate 16, $E_M$ the marking substance reaction energy at whose exceeding the desired reaction, in the exemplary embodiment the red color change, occurs.

During a time interval $t_H$, a laser beam is produced having a high laser energy $E_H$ that exceeds the threshold value $E_S$ for cutting the paper substrate 16, and the laser beam is guided here such that a sub-piece 14-1 (FIG. 2) of the opening 14 is cut.

Then the laser power is reduced for a time interval $t_L$ to a lower laser energy $E_L$ that no longer suffices to cut the substrate 16, but still lies above the reaction energy $E_M$ of the marking substance. Here, the laser beam is guided in the marking region 20 in the form of a pentagonal sub-piece 18-1 of the desired marking 18.

Thereafter, the laser energy is increased again for a time interval $t_H$ to the laser energy $E_H$ and the next sub-piece 14-2 of the opening cut. In a further time interval $t_L$ with low laser energy $E_L$, the next sub-piece 18-2 of the marking 18 is produced. This process is continued until the entire opening 14 and the entire marking 18 are finished. Since the opening 14 and the marking 18 are produced in the same operation with the same laser beam, they are highly precisely registered with each other.

Figure 4:
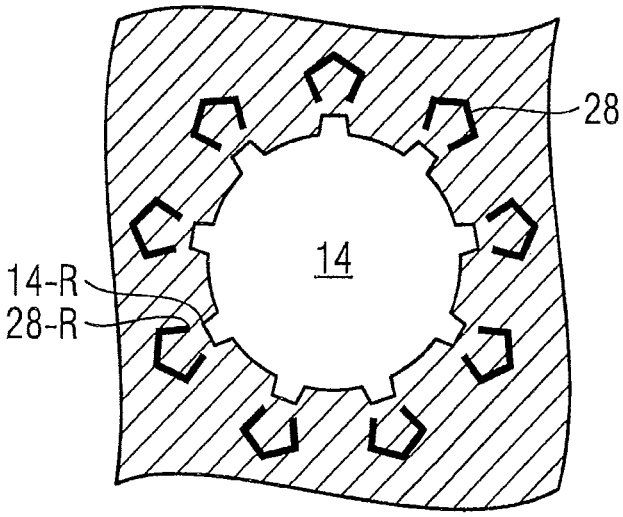
FIGS. 4 and 5 are detailed views of feature regions according to further exemplary embodiments of the present invention.

FIG. 4 shows a further exemplary embodiment of the present invention in which the through opening 14 and the highly precisely registered marking 28 are produced spaced apart. For this, in a time interval $t_0$ between the laser cutting ($t_H$) and the laser marking ($t_L$), the laser energy is lowered to zero or at least a value $E_0$ that lies below the reaction energy $E_M$, and in this time interval, the laser beam is guided from the edge 14-R of the opening 14 to a starting point 28-R of the marking sub-piece to be introduced. After completion of the marking sub-piece with laser energy $E_L$, the laser energy is lowered to $E_0$ again, the laser beam guided back to the edge point 14-R of the opening 14, and the cutting of the opening continued. In this way, an opening 14 and a highly precisely registered, spaced-apart marking 28 are created.

Figure 5:
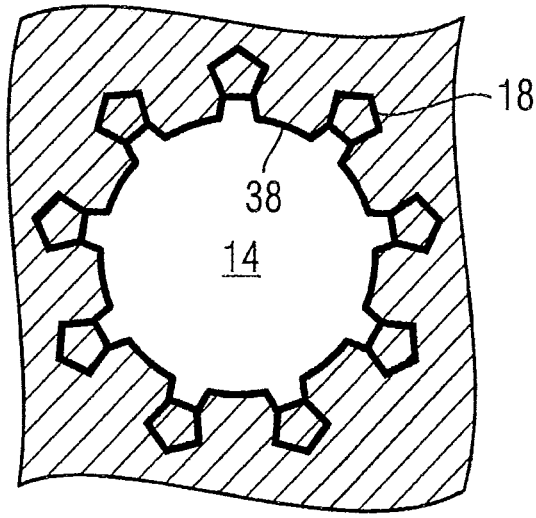

In the further exemplary embodiment shown in FIG. 5, not only the region of the marking to be produced, but also the region of the opening to be introduced is provided with the laser-modifiable marking substance. In this way, in addition to the marking 18 produced as in the exemplary embodiment in FIG. 2, upon cutting the opening 14, an effect edge 38 is produced that is perfectly registered with the opening 14 and the marking 18.

The creation of this effect edge 38 upon laser cutting comes from the substantially Gaussian spatial energy distribution of the cutting laser beam. While the threshold energy $E_S$ needed to cut the substrate 16 is exceeded in an inner region of the cutting laser beam, the energy density of the cutting laser beam outside of the laser spot drops continuously down to zero. There thus exists an outer region of the cutting laser beam in which the local energy lies between $E_M$ and $E_S$ such that a color change of the marking substance is induced in this region but the substrate is not cut. In this way, upon laser cutting, the paper substrate 16 is colored in an edge region 38 of the cut opening 14 in perfect registration with the opening 14 and the marking 18. Here, the width of the colored edge region 38 depends on the beam profile of the laser beam, the reaction energy of the marking substance used and the material properties of the substrate 16.

In addition to the modification of the marking substance by the laser radiation itself, also a modification by the heat produced in laser beam cutting may be used. In this way, the modified edge region of the opening can even be larger than the beam expansion.

It is also possible that the marking substance is ablated or destroyed immediately next to the cut edge of the opening 14 and is modified only starting at a certain small distance from the cut edge. If the marking substance is ablated or destroyed, for example, above a laser energy $E_D$, where $E_M<E_D<E_S$ applies, then the marking substance is ablated in an inner edge region of the laser beam in which $E_D<E<E_S$ applies for the local energy, and modified in an edge region of the laser beam located further out, in which $E_M<E<E_D$ applies. Upon laser cutting, an opening 14 is then created that exhibits, in addition to the highly precisely registered marking 18, a perfectly registered modification region surrounding the edge of the opening 14 at a small distance.

The invention claimed is:

1. A method for manufacturing a security feature, for a security element, a security paper or a data carrier, that exhibits a substrate into which at least one through opening and at least one marking in registration with the through opening are to be introduced, the method comprising:

a) providing a substrate with a laser-modifiable marking substance at least in the region of the marking to be produced, and b) in the same operation b1) introducing at least one through opening into the substrate by the action of laser radiation at higher laser power, and b2) modifying the laser-modifiable marking substance in the marking region by the action of laser radiation at lower laser power whereby a plurality of markings in the marking region surrounding the through opening and in registration with the through opening are produced.

2. The method according to claim 1, wherein at least one through opening and at least one registered marking are produced transitioning into one another without spacing.

3. The method according to claim 1, wherein at least one through opening and at least one registered marking are produced spaced apart.

4. The method according to claim 1, wherein the substrate is kept free from laser-modifiable marking substance in the region of the through openings.

5. The method according to claim 1, wherein the substrate is provided with laser-modifiable marking substance also in the region of the through openings such that the laser-modifiable marking substance is modified in the vicinity of the openings by the same laser beam when introducing the through openings.

6. The method according to claim 5, wherein the laser-modifiable marking substance is modified by the action of laser radiation in an edge region of the openings that immediately adjoins the openings to be produced.

7. The method according to claim 1, wherein the substrate is coated with the laser-modifiable marking substance.

8. The method according to claim 1, wherein the laser-modifiable marking substance is introduced into the volume of the substrate.

9. The method according to claim 1, wherein the substrate is formed from paper.

10. The method according to claim 9, wherein the laser-modifiable marking substance is added to the paper pulp at sheet formation.

11. The method according to claim 9, wherein the laser-modifiable marking substance is introduced into the volume of the substrate in an immersion bath.

12. The method according to claim 9, wherein the substrate is impregnated with the laser-modifiable marking substance in a size press.

13. The method according to claim 1, wherein the substrate is formed from a plastic foil.

14. The method according to claim 1, wherein the laser-modifiable marking substance has a visible color that is changed by the action of the laser radiation.

15. The method according to claim 1, wherein the laser-modifiable marking substance has infrared-absorbing, magnetic, electrical or luminescent properties that are changed by the action of the laser radiation.

16. The method according to claim 1, wherein the through openings are produced in the form of perforations, cuts or expansive window regions.

17. The method according to claim 1, wherein laser-modifiable effect pigments are used as the laser-modifiable marking substance.

18. The method according to claim 1, wherein a pigment-free laser-modifiable marking substance is used.

19. The method according to claim 1, wherein laser radiation in the ultraviolet or visible spectral range is used to introduce the openings and to modify the laser-modifiable marking substance.

20. The method according to claim 1, wherein laser radiation in the infrared spectral range, especially laser radiation of a $CO_2$ laser at a wavelength of about 10.6 μm, is used to introduce the openings and to modify the laser-modifiable marking substance.

21. The method according to claim 1, wherein the security element, the security paper, or the data carrier is used to secure at least one object.

* * * * *

UNITED STATES PATENT AND TRADEMARK OFFICE

CERTIFICATE OF CORRECTION

PATENT NO. : 8,573,650 B2
APPLICATION NO. : 12/665214
DATED : November 5, 2013
INVENTOR(S) : Gregarek et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 547 days.

Signed and Sealed this
Twenty-second Day of September, 2015

Michelle K. Lee

Michelle K. Lee
*Director of the United States Patent and Trademark Office*